US011305852B2

(12) United States Patent
Zhou

(10) Patent No.: US 11,305,852 B2
(45) Date of Patent: Apr. 19, 2022

(54) FOLDING INFLATION-FREE BREASTSTROKE FLOAT

(71) Applicant: Zhejiang Mambobaby Baby Products Co., Ltd., Yiwu (CN)

(72) Inventor: Weixin Zhou, Jinhua (CN)

(73) Assignee: Zhejiang Mambobaby Baby Products Co., Ltd., Yiwu (CN)

( * ) Notice: Subject to any disclaimer, the term of this patent is extended or adjusted under 35 U.S.C. 154(b) by 0 days.

(21) Appl. No.: 17/033,803

(22) Filed: Sep. 27, 2020

(65) Prior Publication Data

US 2021/0009245 A1 Jan. 14, 2021

(30) Foreign Application Priority Data

Jul. 6, 2020 (CN) ..... 202021298040.6

(51) Int. Cl.
*B63C 9/18* (2006.01)
*B63C 9/115* (2006.01)

(52) U.S. Cl.
CPC ..... *B63C 9/115* (2013.01)

(58) Field of Classification Search
CPC ..... B63C 9/1255; B63C 9/155; B63C 9/18; B63C 9/081
See application file for complete search history.

(56) References Cited

U.S. PATENT DOCUMENTS 1,156,749 A * 10/1915 Brown ..... B63C 9/155 441/108
4,654,016 A * 3/1987 Pendleton ..... B63C 9/115 441/116
6,666,622 B1 * 12/2003 Courtney ..... B63C 9/08 405/186
10,793,235 B2 * 10/2020 Zhou ..... B63B 34/50
2015/0044922 A1 * 2/2015 Flythe, Jr. ..... A41D 13/0012 441/106
2020/0346724 A1 * 11/2020 Zhou ..... B63C 9/081

* cited by examiner

*Primary Examiner* — Stephen P Avila

(57) ABSTRACT

A folding inflation-free breaststroke float comprises a U-shaped main body and a supporting pad arranged in the main body. The supporting pad is arranged around an inner ring of the main body; the main body is also provided with back sheets, shoulder straps, buckles and a crotch; the main body is combined by at least two connecting parts; the joined connecting parts can be turned or disassembled and then overlapped; and a detachable connecting piece is arranged between the joined connecting parts. Compared with the prior art, by turning a first connecting part and second connecting parts, the first connecting part and the second connecting parts are overlapped, thereby reducing the overall volume during transportation and reducing transportation cost.

7 Claims, 6 Drawing Sheets

FOLDING INFLATION-FREE BREASTSTROKE FLOAT

TECHNICAL FIELD

The present invention belongs to the technical field of swimming rings of children, and particularly relates to a folding inflation-free breaststroke float.

BACKGROUND

The swimming rings generally involve the children and the young generation. The swimming rings have the characteristics of safety, hygiene and novelty, and are the best product for baby fitness and games. The swimming rings are cute in shape, attractive in style, bright in color, convenient to carry, and not bored to play, and are newest playmates for babies.

At present, the breaststroke floats for infants may be made of foam materials and inflatable plastic materials. A foam lifebuoy is not affected by scratching during use, and may not sink even if it is pierced. It can also float when it is broken. The most basic thing is to ensure life safety at critical moments. The foam lifebuoy is safe and reliable in performance, and has the disadvantage that the foam lifebuoy is larger than the inflatable lifebuoy during storage or transportation, and requires more space for storage.

The breaststroke float is of a hollow ring structure generally. During transportation of a plurality of breaststroke floats, because the breaststrokes floats with the foam structure cannot be compressed, a large gap exists between adjacent breaststroke floats and a large gap also exists in the middles of the breaststroke floats. The space is wasted. The number of the breaststroke floats transported per unit space (per cubic meter) is small, which increases the transportation cost of the breaststroke floats.

SUMMARY

To overcome the defects in the above prior art, the present invention provides a folding inflation-free breaststroke float, which is convenient to stack, low in transportation cost and small in space occupation rate.

To achieve the above purpose, the present invention adopts the following technical solution: a folding inflation-free breaststroke float comprises a U-shaped main body and a supporting pad arranged in the main body. The supporting pad is arranged around an inner ring of the main body; the main body is also provided with back sheets, shoulder straps, buckles and a crotch; the main body is combined by at least two connecting parts; the joined connecting parts can be turned and overlapped; and a detachable connecting piece is arranged between the joined connecting parts.

As a preferred solution of the present invention, the main body is combined by a first connecting part and second connecting parts; the first connecting part and the second connecting parts are arranged independently or connected partially; and the connecting piece is located at the joint between the first connecting part and the second connecting parts.

As a preferred solution of the present invention, a part of the joint between the first connecting part and the second connecting parts is located at the top or bottom of the main body.

As a preferred solution of the present invention, the first connecting part and the second connecting parts are symmetrically arranged along the center line of the U-shaped main body.

As a preferred solution of the present invention, the first connecting part is located on the U-shaped bottom of the main body, and the second connecting parts, are symmetrically arranged on both, sides of the first connecting part.

As a preferred solution of the present invention, the connecting piece is a strip-shaped zipper or a strip-shaped hook & loop or a fastener or a stretchable belt structure.

As a preferred solution of the present invention, the main body is provided with a headrest, and the headrest and the main body are integrally formed or detachably connected.

As a preferred solution of the present invention, the headrest is located in the middle of the main body.

As a preferred solution of the present invention, the headrest and the main body are detachably connected by an annular hook & loop or annular zipper.

As a preferred solution of the present invention, the main body has a foamed structure, and a main body sheath is sleeved outside the main body.

The present invention has the following beneficial effects: compared with the prior art, by turning the first connecting part and the second connecting parts, the first connecting part and the second connecting parts are overlapped, thereby reducing the overall volume during transportation and reducing transportation cost. At the same time, the first connecting part and the second connecting parts are connected by the connecting piece during use, and the headrest and the main body are also installed and connected during use. The above components can be disassembled during transportation.

Figure 1:
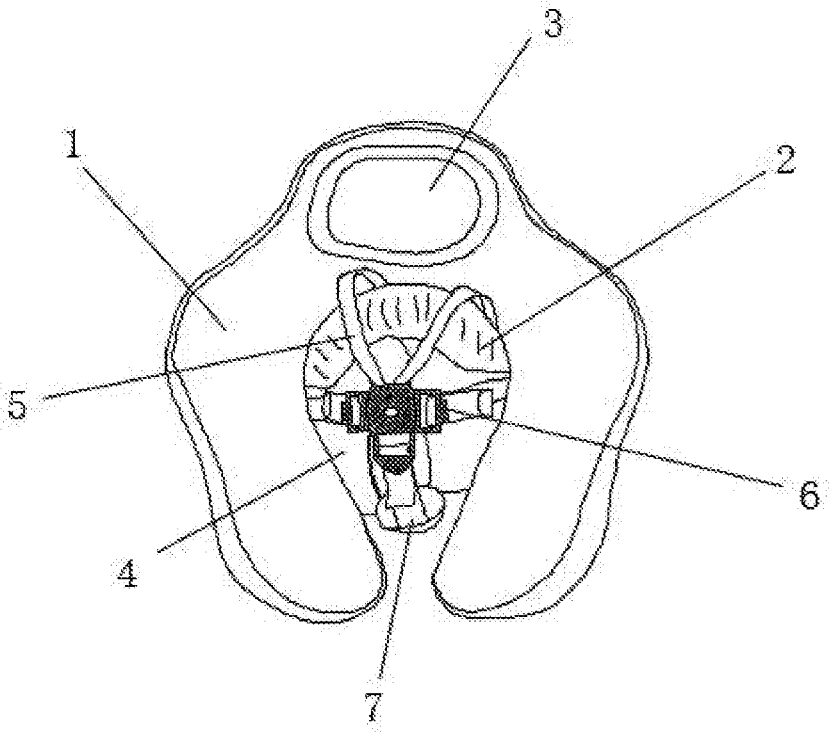
FIG. 1 is a front view of the present invention.

Reference signs in the figures: main body 1; first connecting part 1-1: second connecting part 1-2; annular hook & loop 1-3: annular zipper 1-4; supporting pad 2; headrest 3: strip-shaped zipper 4; strip-shaped hook & loop 5; fastener 6; stretchable belt 7; back piece 8; shoulder strap 9; buckle 10; crotch 11.

DETAILED DESCRIPTION

The embodiments of the present invention are described in detail below in combination with the drawings.

Figure 2:
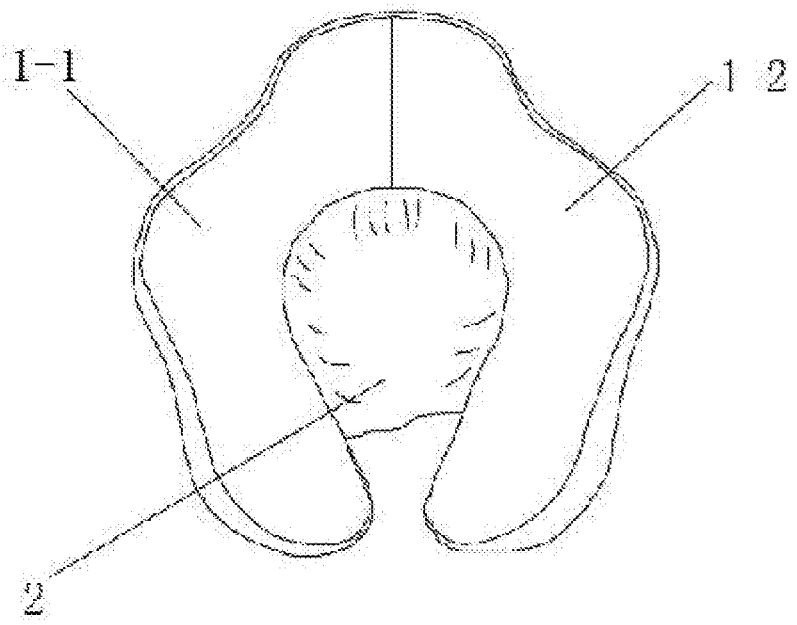
FIG. 2 is a back view of the present invention.
Figure 3:
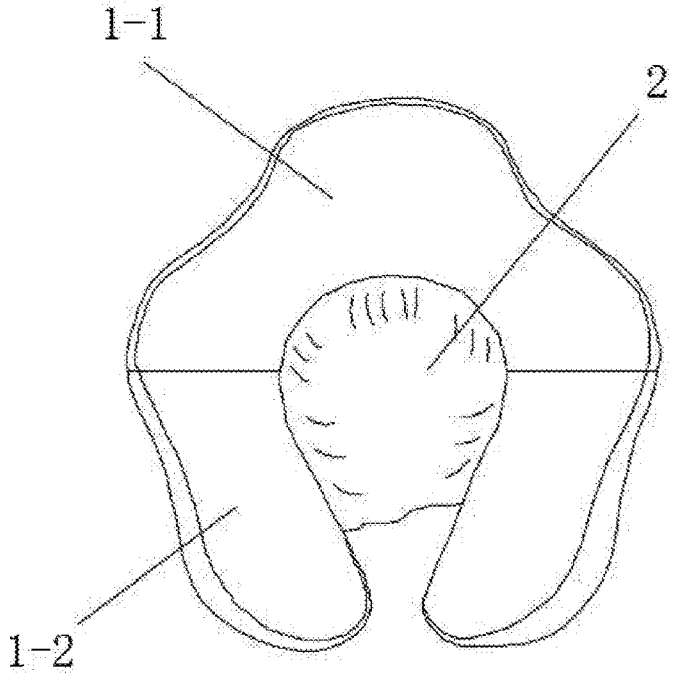
FIG. 3 is a back view of the present invention.
Figure 4:
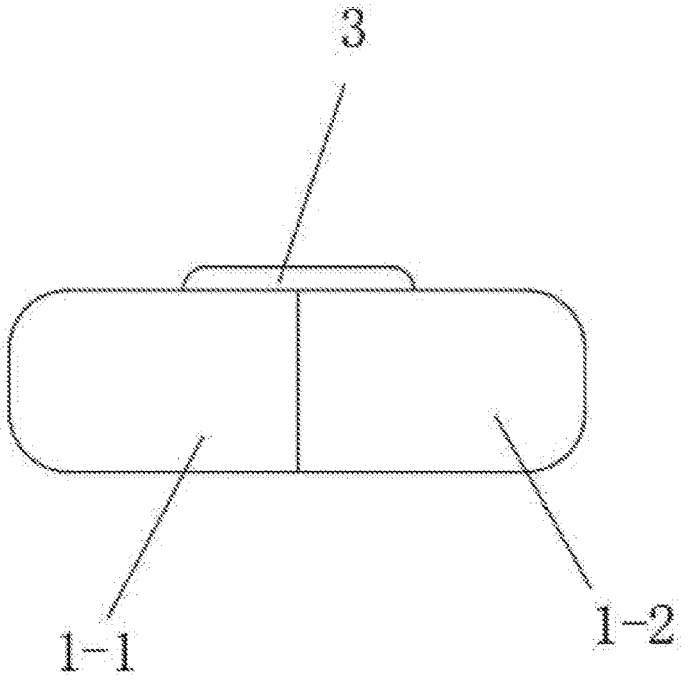
FIG. 4 is a top view of the present invention.
Figure 5:
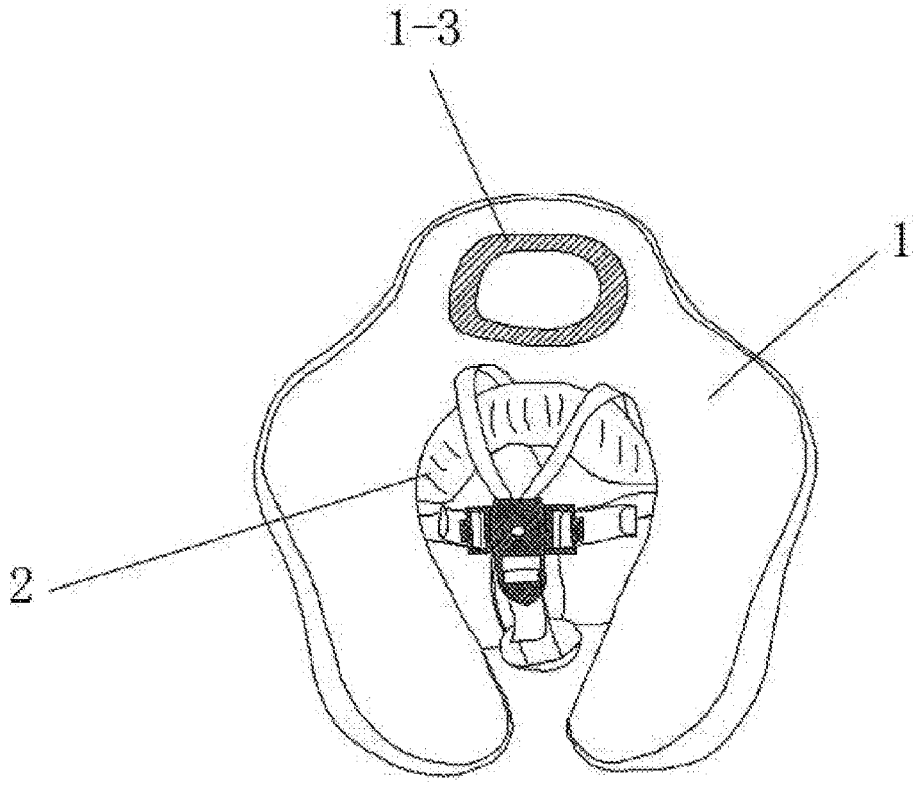
FIG. 5 is a structural schematic diagram of a main body provided with an annular hook & loop.
Figure 6:
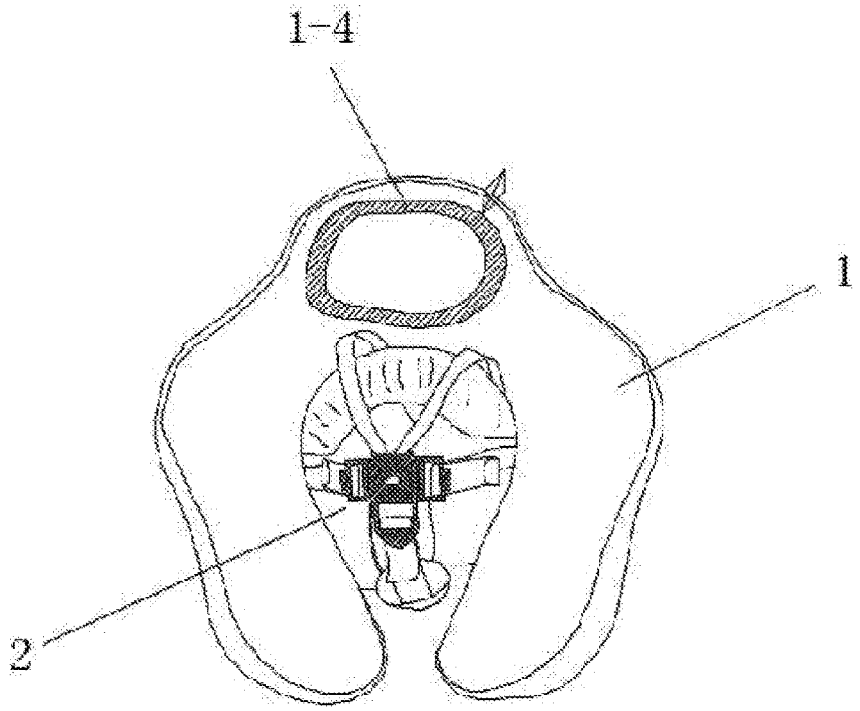
FIG. 6 is a structural schematic diagram of a main body provided with an annular zipper.
Figure 7:
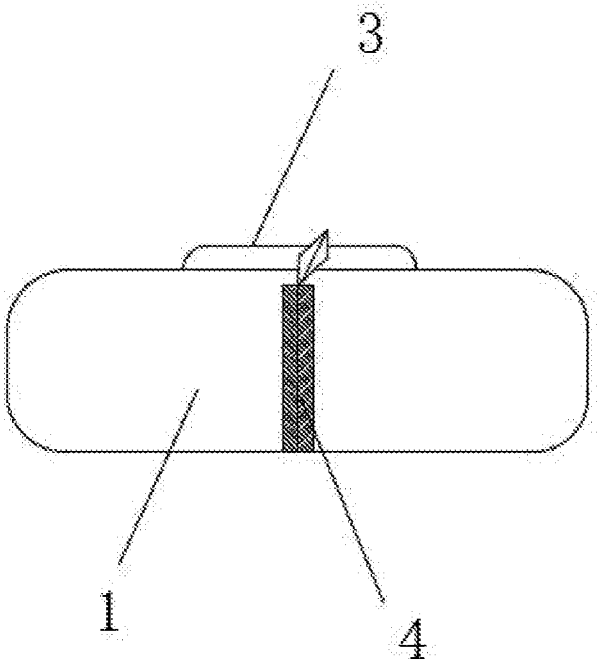
FIG. 7 is a structural schematic diagram of a main body provided with a strip-shaped zipper.
Figure 8:
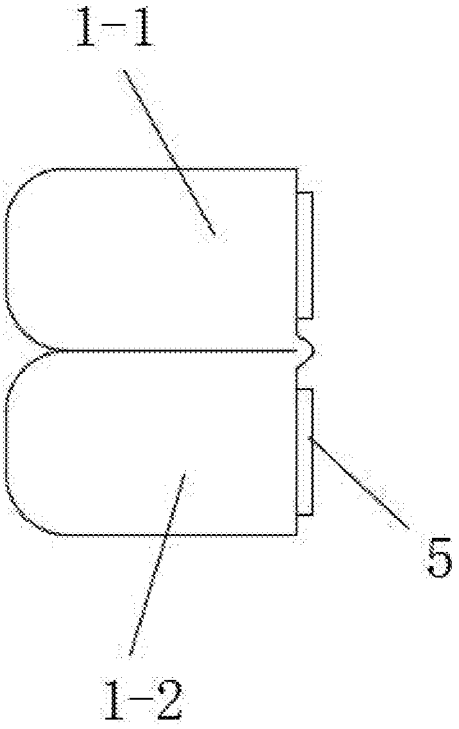
FIG. 8 is a structural schematic diagram of a main body provided with a strip-shaped hook & loop.
Figure 9:
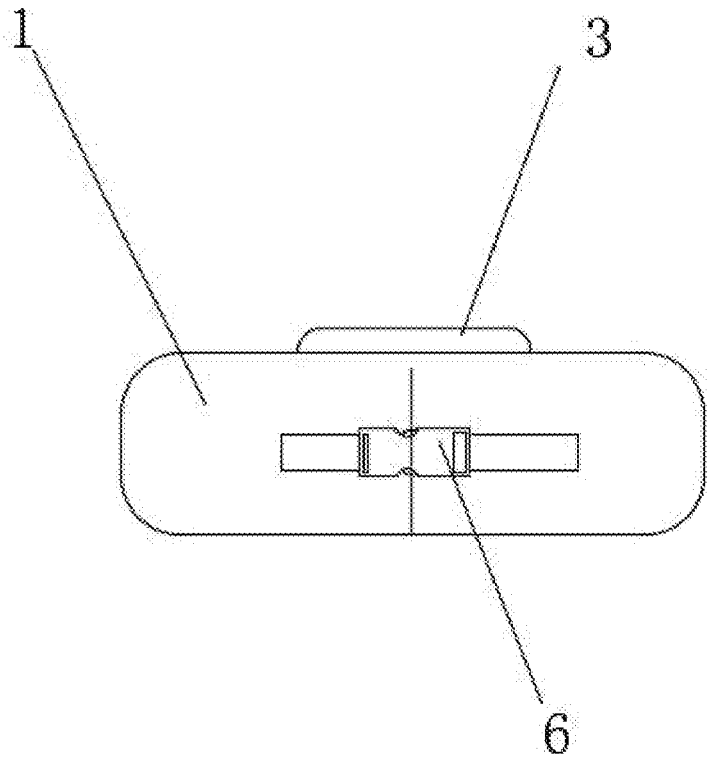
FIG. 9 is a structural schematic diagram of a main body provided with a fastener.
Figure 10:
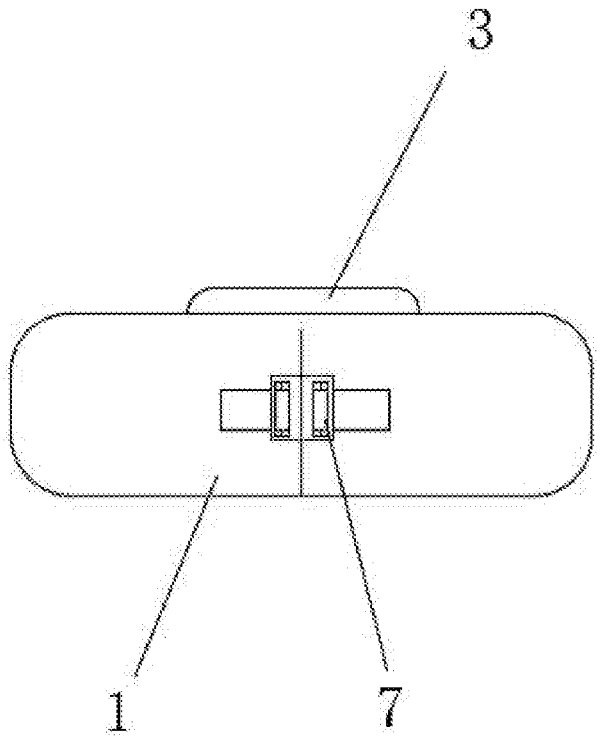
FIG. 10 is a structural schematic diagram of a main body provided with a stretchable belt.

As shown in FIGS. 1-10, a folding inflation-free breaststroke float comprises a U-shaped main body 1 and a supporting pad 2 arranged in the main body 1. The supporting pad 2 is arranged around an inner ring of the main body 1; the main body 1 is combined by a first connecting part 1-1 and second connecting parts 1-2; the first connecting part 1-1 and the second connecting parts 1-2 can be turned and overlapped; and a detachable connecting piece is arranged between the first connecting part 1-1 and the second connecting parts 1-2. The main body 1 is connected with two back sheets 8 corresponding to the supporting pad 2. The two back sheets 8 are detachably connected through a hook & loop. The main body 1 is also provided with two shoulder straps 9, buckles 10 and a crotch 11. Two buckles are detachably connected. The main body 1 is detachably provided with a headrest 3.

The main body 1 can be combined by a plurality of connecting parts. The plurality of connecting parts are distributed along the arc length direction of the main body 1. The quantity of the connecting parts is set according to actual needs, and the sizes of the connecting parts is also set according to the actual needs. The turning directions at both ends of the connecting parts are opposite.

The main body 1 has a foamed structure, and a main body sheath is sleeved outside the main body 1. The main body sheath has a net cloth structure. The main body sheath is connected with the connecting piece and the headrest. The supporting pad 2 is always <connected with the first connecting part 1-1 and the second connecting parts 1-2. The supporting pad 2 also has a net cloth structure and has certain elasticity. During turning and overlapping of the first connecting part 1-1 and the second connecting parts 1-2, the deformation amount of the supporting pad 2 meets the movement amount of the first connecting part 1-1 and the second connecting parts 1-2 during turning.

The first connecting part 1-1 and the second connecting parts 1-2 are arranged independently or connected partially; and the connecting piece is located at the joint between the first connecting part 1-1 and the second connecting parts 1-2. A part of the joint between the first connecting part 1-1 and the second connecting parts 1-2 is located at the top or bottom of the main body 1.

When the first connecting part 1-1 and the second connecting parts 1-2 are arranged independently, the first connecting part 1-1 and the second connecting parts 1-2 are not connected; and the first connecting part 1-1 and the second connecting parts 1-2 are connected by the connecting piece. When the first connecting part 1-1 and the second connecting parts 1-2 are connected partially, the first connecting part 1-1 and the second connecting parts 1-2 are of an integral structure; and the joint between the first connecting part 1-1 and the second connecting parts 1-2 does not impede the turning between the first connecting part 1-1 and the second connecting parts 1-2.

The first connecting part 1-1 and the second connecting parts 1-2 are symmetrically arranged along the center line of the U-shaped main body 1. At this moment, the structure of the first connecting part 1-1 and the structures of the second connecting parts 1-2 are, equal and symmetrical, which is convenient for turning and overlapping between the first connecting part 1-1 and the second connecting parts 1-2.

The first connecting part 1-1 is located on the U-shaped bottom of the main body 1, and the second connecting parts 1-2 are symmetrically arranged on both sides of the first connecting part 1-1. At this time, the first connecting part 1-1 is connected with two second connecting parts 1-2, and, the second connecting parts 1-2 are turned and then overlapped on the first connecting part 1-1.

The connecting piece is a strip-shaped zipper 4 or a strip-shaped hook & loop 5 or a fastener 6 or a stretchable belt 7 structure.

When the connecting piece is the strip-shaped zipper 4, the strip-shaped zipper 4 is fixedly connected to the main body sheath by sewing, and the strip-shaped zipper 4 is respectively arranged on the first connecting part 1-1 and the second connecting parts 1-2. The strip-shaped zipper 4 is tightened or released to adjust the separation or connection between the first connecting part 1-1 and the second connecting parts 1-2.

When the connecting piece is the strip-shaped hook & loop 5, the strip-shaped hook & loop 5 is arranged at the notch of the first connecting part 1-1 and the second connecting parts 1-2. One side of the first connecting part 1-1 and the second connecting parts 1-2 is provided with a loop, and the other side is provided with a hook. When the first connecting part 1-1 and the second connecting parts 1-2 are close and attached to each other, the first connecting part 1-1 and the second connecting parts 1-2 are connected by the hook & loop 5.

When the connecting piece is the fastener 6, the fastener 6 is arranged on the side walls of the first connecting part 1-1 and the second connecting parts 1-2, and both ends of the fastener 6 are provided with two connecting straps. The two connecting straps are fixedly connected to the main body sheath by sewing, and the end parts of the two connecting straps are connected with adaptive locking fasteners. The separation or connection between the first connecting part 1-1 and the second connecting parts 1-2 is adjusted through the connection and separation of the locking, fasteners.

When the connecting piece is the stretchable belt 7, the stretchable belt 7 comprises two connecting straps and connecting sheets. The two connecting straps are fixedly connected to the main body sheath by sewing. The connecting sheets are twined on the connecting straps. The separation or connection between the first connecting part 1-1 and the second connecting parts 1-2 is adjusted through the connection and separation of the connecting straps and the connecting sheets.

The headrest 3 is located in the middle of the main body 1. The headrest 3 and the main body 1 are detachably connected by an annular hook & loop 1-3 or annular zipper 1-4. The size of the annular hook & loop 1-3 or the annular zipper 1-4 is annularly set according to the structure of the headrest 3. The headrest 3 is fixedly connected to the main body sheath by sewing.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

Although more reference signs in the figures are used herein main body 1; first connecting part 1-1, second connecting part 1-2, annular hook & loop 1-3, annular zipper 1-4, supporting pad 2, headrest 3, strip-shaped zipper 4, strip-shaped hook & loop 5, fastener 6, stretchable belt 7, back piece 8, shoulder strap 9, buckle 10 and crotch 11, the possibility of using other terms is not excluded. These terms are only used to describe and explain the essence of the present invention more conveniently. It is contrary to the spirit of the present invention to explain these terms as any additional limitation.

The invention claimed is:

1. A folding inflation-free breaststroke float, comprising a U-shaped main body and a supporting pad arranged in the main body, wherein the supporting pad is arranged around an inner ring of the main body; the main body is also provided with back sheets, shoulder straps, buckles and a crotch, wherein the main body is combined by at least two connecting parts; joined connecting parts can be turned or disassembled and then overlapped; and a detachable connecting piece is arranged between the joined connecting parts;

the main body comprises a first connecting part and a second connecting part; the first connecting part and the second connecting part are partially connected by a joint; the joint is located at a top or bottom of the main body;

the first connecting part comprises a first side, the second connecting part comprises a second side; the first side faces to the second side when the first connecting part and the second connecting part are unfolded; the detachable connecting piece is a strip-shaped hook & loop; a hook of the strip-shaped hook & loop is arranged on one of the first side and the second side; and a loop of the strip-shaped hook & loop is arranged on other of the first side and the second side.

2. The folding inflation-free breaststroke float according to claim 1, wherein the first connecting part and the second connecting parts are symmetrically arranged along the center line of the U-shaped main body.

3. The folding inflation-free breaststroke float according to claim 1, wherein the first connecting part is located on the U-shaped bottom of the main body, and the second connecting parts are symmetrically arranged on both sides of the first connecting part.

4. The folding inflation-free breaststroke float according to claim 1, wherein the main body is provided with a headrest, and the headrest and the main body are integrally formed or detachably connected.

5. The folding inflation-free breaststroke float according to claim 4, wherein the headrest is located in the middle of the main body.

6. The folding inflation-free breaststroke float according to claim 4, wherein the headrest and the main body are detachably connected by an annular hook & loop or annular zipper.

7. The folding inflation-free breaststroke float according to claim 1, wherein the main body has a foamed structure, and a main body sheath is sleeved outside the main body.

* * * * *